US005679031A

United States Patent [19]

Chadbourne et al.

[11] Patent Number: 5,679,031

[45] Date of Patent: Oct. 21, 1997

[54] ELECTRICAL WEDGE CONNECTOR WITH RETENTION BARBS

[75] Inventors: Richard Chadbourne, Merrimack; William J. Lasko, Lisbon, both of N.H.

[73] Assignee: Framatome Connectors USA Inc., Norwalk, Conn.

[21] Appl. No.: 518,744

[22] Filed: Aug. 23, 1995

[51] Int. Cl.[6] ..... H01R 4/50

[52] U.S. Cl. ..... 439/783

[58] Field of Search ..... 439/783, 417, 439/435, 436, 433, 863

[56] References Cited

U.S. PATENT DOCUMENTS

| | | | |
|---|---|---|---|
| 2,106,724 | 2/1938 | Cope | 173/273 |
| 2,814,025 | 11/1957 | Wade et al. . | |
| 2,828,147 | 3/1958 | Peiffer | 285/138 |
| 3,065,449 | 11/1962 | Matthysse et al. . | |
| 3,275,974 | 9/1966 | Mixon, Jr. . | |
| 3,329,928 | 7/1967 | Broske . | |
| 3,349,167 | 10/1967 | Mixon, Jr. et al. | 174/94 |
| 3,462,543 | 8/1969 | Wahl et al. | 174/94 |
| 3,504,332 | 3/1970 | Mixon, Jr. . | |
| 3,516,050 | 6/1970 | Mixon, Jr. et al. . | |
| 3,588,791 | 6/1971 | Polidori | 439/783 OR |
| 3,811,105 | 5/1974 | Gerhard | 439/417 OR |
| 3,920,310 | 11/1975 | Walsh et al. . | |
| 4,059,333 | 11/1977 | Mixon, Jr. . | |
| 4,533,205 | 8/1985 | Frank . | |
| 4,600,264 | 7/1986 | Counsel . | |
| 4,634,205 | 1/1987 | Gemra . | |
| 4,650,273 | 3/1987 | Roosdrop . | |
| 4,723,920 | 2/1988 | Werner | 439/782 |
| 4,723,921 | 2/1988 | Pooley | 439/783 |
| 4,730,087 | 3/1988 | Werner | 174/94 S |
| 4,734,062 | 3/1988 | Goto | 439/783 |
| 4,813,894 | 3/1989 | Mixon, Jr. | 439/783 |
| 4,863,403 | 9/1989 | Shannon | 439/783 |
| 4,872,856 | 10/1989 | Pooley et al. | 439/783 |
| 4,915,653 | 4/1990 | Mair | 439/781 |
| 5,006,081 | 4/1991 | Counsel et al. | 439/783 |
| 5,044,996 | 9/1991 | Goto | 439/783 OR |
| 5,145,420 | 9/1992 | Counsel et al. | 439/783 |
| 5,244,422 | 9/1993 | Laricchia | 439/783 |
| 5,507,671 | 4/1996 | Chadbourne et al. | 439/783 OR |

FOREIGN PATENT DOCUMENTS

| | | |
|---|---|---|
| 2070302 | 6/1992 | Canada . |
| 0653802 | 5/1995 | European Pat. Off. . |

*Primary Examiner*—P. Austin Bradley
*Assistant Examiner*—Daniel Wittels
*Attorney, Agent, or Firm*—Perman & Green, LLP

[57] ABSTRACT

A wedge connector with a shell and a wedge. The shell has a general "C" shape and is suitably sized and shaped to receive the wedge and a conductor in a receiving area. The conductor is sandwiched between the wedge and the shell. A curved wall of the shell has a hole with an edge of the wall at the hole projecting inwardly into the receiving area.

19 Claims, 1 Drawing Sheet

ELECTRICAL WEDGE CONNECTOR WITH RETENTION BARBS

BACKGROUND OF THE INVENTION

1. Field of the Invention

The present invention relates to electrical connectors and, more particularly, to a wedge connector.

2. Prior Art

U.S. Pat. No. 5,044,996 discloses a wedge connector having a C-member with an inwardly projecting lance to engage the wedge. U.S. Pat. No. 4,650,273 discloses an electrical connector with a general "C" shaped sleeve and a wedge. The wedge is stamped and formed from sheet metal and has a tab at its front end. The tab engages a front end of the sleeve to resist withdrawal of the wedge from the sleeve. U.S. Pat. No. 5,006,081 discloses a wedge connector with a "C" shaped sleeve having a hole in its middle section for engaging a dimple on a stamped and formed sheet metal wedge. U.S. Pat. No. 5,244,422 discloses a wedge connector with a C-member having an inner surface of each channel with a knurled finish. Other U.S. Patents that relates to wedge connectors include the following:

| | |
|---|---|
| 2,106,724 | 2,814,025 |
| 2,828,147 | 3,065,449 |
| 3,275,974 | 3,329,928 |
| 3,349,167 | 3,462,543 |
| 3,504,332 | 3,516,050 |
| 3,588,791 | 3,920,310 |
| 4,059,333 | 4,533,205 |
| 4,600,264 | 4,634,205 |
| 4,723,920 | 4,723,921 |
| 4,730,087 | 4,734,062 |
| 4,813,894 | 4,863,403 |
| 4,872,856 | 4,915,653 |
| 5,145,420 | |

SUMMARY OF THE INVENTION

In accordance with one embodiment of the present invention, a wedge connector is provided comprising a wedge and a shell. The shell is suitably sized and shaped to receive the wedge and a conductor in a receiving area with the conductor being sandwiched between the wedge and the shell. The shell has a curved wall against which the conductor is located. The wall has a hole therethrough. An edge of the wall at the hole projects inwardly into the receiving area.

In accordance with another embodiment of the present invention, a wedge connector is provided comprising a wedge and a shell. The shell is suitably sized and shaped to receive the wedge and a conductor in a receiving area with the conductor being sandwiched between the wedge and the shell. The shell has a curved wall against which the conductor is located. The curved wall has an inwardly stamped portion with a sharp edge that projects into the receiving area.

In accordance with one method of the present invention, a method of forming a shell for a wedge connector is provided comprising steps of forming a general C-shaped member; forming a hole through the member at an end curve of the member; and forming a projection at an edge of the hole that projects into a receiving area of the member.

In accordance with another method of the present invention, a method of forming a shell for a wedge connector is provided comprising steps of forming a flat sheet metal member into a general C-shape; cutting a cut into an end edge of the member; and deforming a portion of the member from the cut into a receiving area of the general C-shape to form an inwardly projecting edge.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
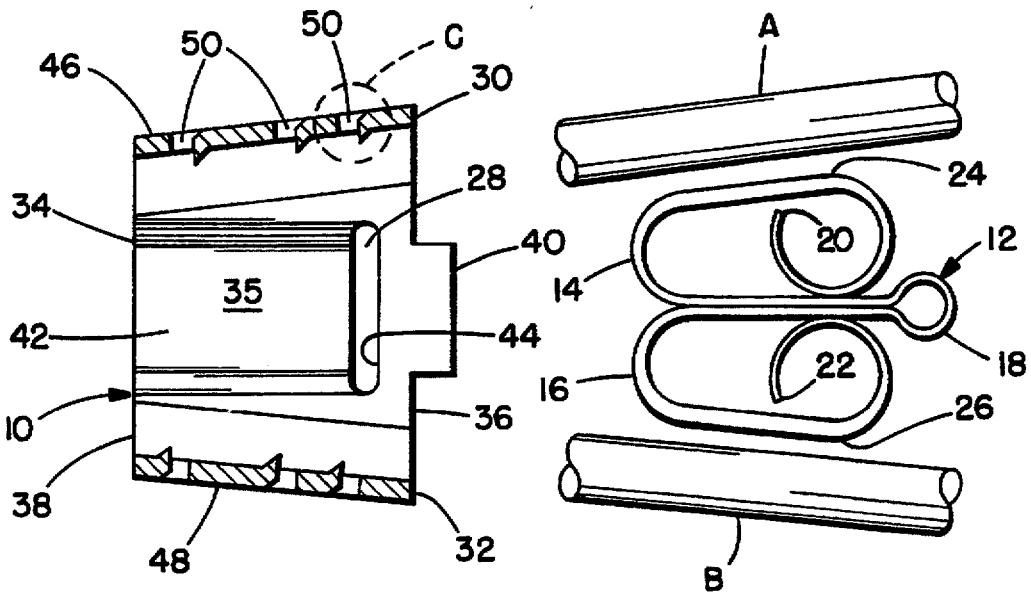
FIG. 1 is an exploded side view of an electrical wedge connector incorporating features of the present invention with two conductors and showing the C-shaped shell in cross section.

Referring to FIG. 1, there is shown an exploded side view of an electrical wedge connector incorporating features of the present invention and two conductors A, B. Although the present invention will be described with reference to the embodiments shown in the drawings, it should be understood that the present invention can be embodied in various different forms of embodiments. In addition, any suitable size, shape, or type of elements or materials could be used.

The wedge connector comprises a shell 10 and a wedge 12. In the embodiment shown, the wedge 12 is comprised of a single elongate sheet metal member that has been formed into the shape shown. The sheet metal member has been folded over itself in a lengthwise direction several times along its length to form the wedge 12. In alternate embodiments, more or less folds could be provided. The wedge 12 has two adjacent main loop sections 14, 16 interconnected by a third loop section 18. The two longitudinal ends 20, 22 of the sheet metal member are located in the two main loops 14, 16, respectively. The third loop 18, in addition to interconnecting the first and second main loops 14, 16 can also function as a back support or containment support for the main loops 14, 16. Sides 24, 26 are suitably sized and shaped to engage the conductors A, B to sandwich the conductors A, B against interior sides of the shell 10. The wedge 12 also has a latch (not shown) for engaging the shell at hole 28 to lock the wedge 12 in the shell 10. A further description of the wedge 12 can be found in U.S. patent application Ser. No. 08/306,463 filed Sep. 15, 1994 which is hereby incorporated by reference in its entirety. However, in alternate embodiments, any suitable type of wedge could be used.

The shell 10 is a one-piece member that is preferably made of sheet metal, but it could also be a cast, drawn, or extruded member. The shell 10 has two opposing channel sections 30, 32 interconnected by a middle section 34 to form a general "C" shape with a receiving area 35 for receiving the wedge 12 and the conductors A, B. The "C" shape tapers from the rear end 36 to the front end 38. The middle section 34 includes a rear end tab 40, a groove or depression 42, and the slot 28. The slot 28 is located proximate the rear end of the shell and forms a stop ledge 44. The slot 28 extends entirely through the middle section 34 from the interior surface to the exterior surface. However, in an alternate embodiment that slot 28 need not extend entirely through the middle section 34. The depression 42 extends from the slot 28 to the front end 38 of the shell 10. In another alternate embodiment, the depression 42 need not be provided or need not extend to the front end 38, but if provided the slot 28 should be located at the rear end of the depression 42.

Figure 2:
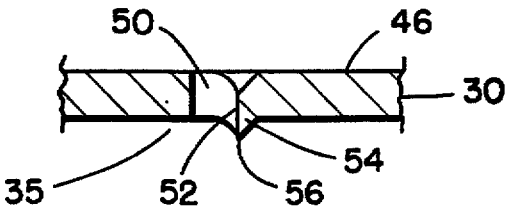
FIG. 2 is an enlarged view of area C shown in FIG. 1.
Figure 3:
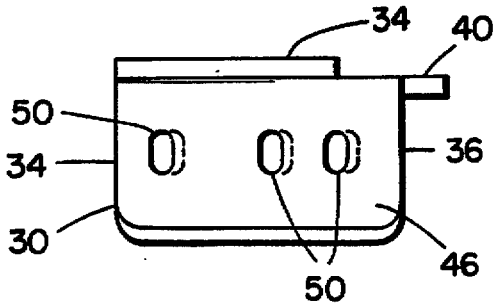
FIG. 3 is a plan top view of the shell shown in FIG. 1.

Referring also to FIGS. 2 and 3, the channel sections 30, 32 are formed from walls 46, 48 at those sections being curved. In the embodiment shown, each curved wall 46, 48 has three holes 50 therethrough. In alternate embodiments more or less than three holes could be provided. In addition, in an alternate embodiment, only one of the walls 46, 48 could have holes 50 through them. At an edge 52 of each hole 50, the edge 52 has been stamped or otherwise moved into the receiving area 35. Thus, at each hole 50, a projection or barb 54 is formed on the sharp edge. In the embodiment shown, only a portion of the total edge of the hole 50 is moved into the receiving area 35. However, in an alternate embodiment the entire edge of the hole could be moved into the receiving area 35. As noted by a comparison of the projections on the top channel section 30 versus the bottom channel section 32 in FIG. 1, the projections can also be on either side of the holes. In the embodiment shown, the holes 50 have a general oval shape and only one side or a little less than 50% of the edge of the oval shape is moved into the receiving area 35. However, in alternate embodiments other different shape holes could be used to provide different shaped projections. By not deforming the tip 56 of the projections 54, the tip 56 can be kept very sharp for better engagement with the conductors A, B.

When the conductors A, B and wedge 12 are inserted into the shell 10, the wedge 12 presses the conductors A, B against the walls 46, 48. The projections 54 cut into the conductors A, B to help retain the conductors in a stationary position in the shell 10. The very sharp tips 56 insure penetration into the conductors A, B and, sufficient penetration depth to securely hold the conductors with the shell 10.

Figure 4:
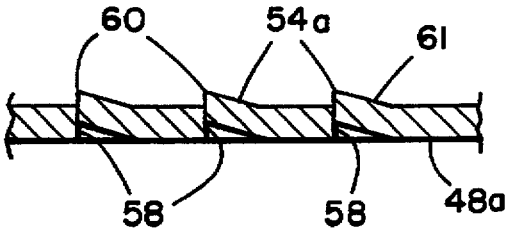
FIG. 4 is a cross-sectional view of a portion of a shell in an alternate embodiment of the present invention.

Referring now to FIG. 4, a cross-sectional view of an alternate embodiment of a curved wall is shown. In this embodiment, the wall 48*a* has projections 54*a*. The wall 48*a* has been stamped to shear the wall at areas 58 to form lanced up edges 60. Ramp sections 61 are formed behind the edges 60 to help guide the conductor over the edges 60 during insertion. However, careful examination of the tips of the edges 60 found that they are not as sharp as the tips 56 of the embodiment shown in FIG. 1, but this type of embodiment could still be used in some applications. Additional operations in tooling may be used to increase the sharpness of the tips.

Figure 5:
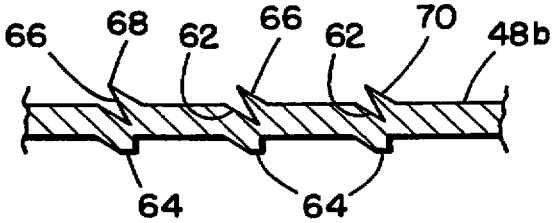
FIG. 5 is a cross-sectional view of a portion of a shell of an alternate embodiment of the present invention.

Referring now to FIG. 5, a cross-sectional view of a curved wall 48*b* of another alternate embodiment is shown. In this embodiment, the flat sheet metal wall 48*b* was pierced by a tool (not shown) to form indented areas 62. The wall 48*b* deflects outward at areas 64 and inward at areas 66. The resulting tip or edge 68 has been found to be extremely sharp. Ramp sections 70 are formed behind the tip 68 to help guide the conductor over the tips 68 during insertion. However, areas 64 could also have sharp edges that might be used to grip a conductor if it was put on the inside of the shell.

Figure 6:
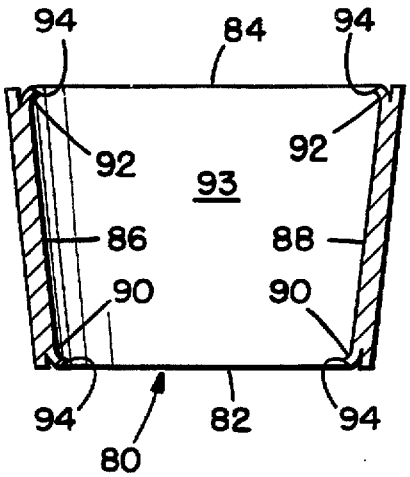
FIG. 6 is a cross-sectional view of a shell of an alternate embodiment of the present invention.

Referring now to FIG. 6, a cross-sectional view of an alternate embodiment of a shell 80 is shown. In this embodiment, cuts or upsets are cut or formed into the front end edge 82 and the rear end edge 84 at the channel sections 86, 88. Portions 90, 92 are then deformed or otherwise moved in towards the receiving area 93. These portions 90, 92 thus form inwardly projecting projections 94 with sharp edges to engage the conductors. In an alternate embodiment, both end projections 94 and projections in the interior of the channel sections could be provided.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A wedge connector comprising:

a wedge; and a shell suitably sized and shaped to receive the wedge and a conductor in a receiving area with the conductor being sandwiched between the wedge and the shell, the shell having a curved wall against which the conductor is located, the wall having a hole therethrough, an edge of the wall at the hole projects inwardly into the receiving area.

2. A wedge connector as in claim 1 wherein the shell is comprised of sheet metal.

3. A wedge connector as in claim 1 wherein the shell has a general "C" shape.

4. A wedge connector as in claim 1 wherein the curved wall has a plurality of holes therethrough with inwardly projecting edges at each hole.

5. A wedge connector as in claim 1 wherein the edge extends into the receiving area from less than 50 percent of a total edge formed by the hole.

6. A wedge connector comprising:

a wedge; and a shell suitably sized and shaped to receive the wedge and a conductor in a receiving area with the conductor being sandwiched between the wedge and the shell, the shell having a curved wall against which the conductor is located, the curved wall having a plurality of holes therethrough with an inwardly stamped portion with a sharp edge that projects into the receiving area at each hole.

7. A wedge connector as in claim 6 wherein the shell is comprised of sheet metal.

8. A wedge connector as in claim 6 wherein the shell has a general "C" shape.

9. A wedge connector as in claim 6 wherein the edges extend into the receiving area from less than 50 percent of a total edge formed by each of the holes.

10. A wedge connector comprising:

a wedge; and a shell suitably sized and shaped to receive the wedge and a conductor in a receiving area with the conductor being sandwiched between the wedge and the shell, the shell having a curved wall against which the conductor is located, the curved wall having an exterior side and an interior side, wherein the exterior side is parallel to the interior side and is inwardly stamped forming an indentation therein and a matching protrusion on the interior side opposite the indentation, the protrusion having a sharp lanced up edge that projects into the receiving area.

11. A wedge connector as in claim 10 wherein the curved wall is sheared between the indentation and the lanced up edge.

12. A wedge connector as in claim 11 wherein the protrusion has a ramp section behind the lanced up edge.

13. A wedge connector comprising:

a wedge; and a shell suitably sized and shaped to receive the wedge and a conductor in a receiving area with the conductor being sandwiched between the wedge and the shell, the shell having a curved wall against which the conductor is located, the curved wall having an interior side that has been pierced at an acute angle to form an inwardly projecting lance with a general arrowhead shaped cross-section terminating in a sharp edge that projects into the receiving area and a recess located in the interior side of the curved wall in front of and beneath the inwardly projecting lance.

14. A wedge connector as in claim 13 wherein the lance has a first side forming a ramp in the receiving area and a second side facing the recess, the second side being angled towards the first side so that the first side and second side intersect to form the sharp edge.

15. A wedge connector as in claim 13 wherein the curved wall has an exterior side with outward deflected areas formed by the piercing of the interior side.

16. A wedge connector as in claim 13 wherein the recess in the interior side has a generally V-shaped cross section.

17. A wedge connector comprising:

a wedge; and a shell suitably sized and shaped to receive the wedge and a conductor in a receiving area with the conductor being sandwiched between the wedge and the shell, the shell having a curved wall against which the conductor is located, the curved wall having an interior side that has been pierced at an acute angle relative to the interior side forming a recess therein and a pointed barb having a sharp edge projecting into the receiving area.

18. A wedge connector as in claim 17 wherein the barb has a longitudinal cross-section with a substantially straight inner side and a substantially straight outer side converging with the inner side to form the sharp edge.

19. A wedge connector as in claim 17 wherein the recess in the interior side has a generally V-shaped cross section opening on the interior side in front of the barb and extending beneath the barbs.

* * * * *